United States Patent [19]

Yoneda et al.

[11] Patent Number: 4,975,048

[45] Date of Patent: Dec. 4, 1990

[54] HEATING APPARATUS

[75] Inventors: Terumasa Yoneda; Akihiko Suzuki, both of Nara; Hiroshi Takakura, Suita, all of Japan

[73] Assignees: Sharp Kabushiki Kaisha; Kabushiki Kaisha Excell, Japan

[21] Appl. No.: 387,702

[22] Filed: Jul. 31, 1989

[30] Foreign Application Priority Data

Aug. 16, 1988 [JP] Japan ..... 63-203358

[51] Int. Cl.[5] ..... F27B 9/28

[52] U.S. Cl. ..... 432/59; 432/122; 432/234

[58] Field of Search ..... 432/121, 122, 123–126, 432/234, 59

[56] References Cited

U.S. PATENT DOCUMENTS

| | | | |
|---|---|---|---|
| 3,792,965 | 2/1974 | Bengtsson | 432/122 |
| 3,887,064 | 6/1975 | Brockmann | 432/122 |
| 4,025,298 | 5/1977 | Tokitsu | 432/122 |
| 4,820,150 | 4/1989 | Ushijima | 432/234 |

*Primary Examiner*—Henry C. Yuen
*Attorney, Agent, or Firm*—Irell & Manella

[57] ABSTRACT

A heating apparatus comprising a heating chamber the inside of which is heated to a fixed temperature and which is provided with an entrance and an exit through which articles to be heated are taken in and out of the heating chamber, a support on which the articles are supported inside and outside of the heating chamber, a conveyer which moves vertically and horizontally so that the top surface of the conveyer is above and below the top surface of the conveyer is above and below the top surface of the support and that the conveyer reciprocates in the direction in which the articles are conveyed, and a pair of doors for opening and closing the entrance and exit of the heating chamber, whereby the articles are successively moved over a fixed distance by the conveyer toward the heating chamber, thereby providing a heating apparatus with a simple structure in which articles such as semiconductor devices are conveyed to the heating chamber without vibration and then properly heated in the heating chamber.

4 Claims, 6 Drawing Sheets

FIG.4a
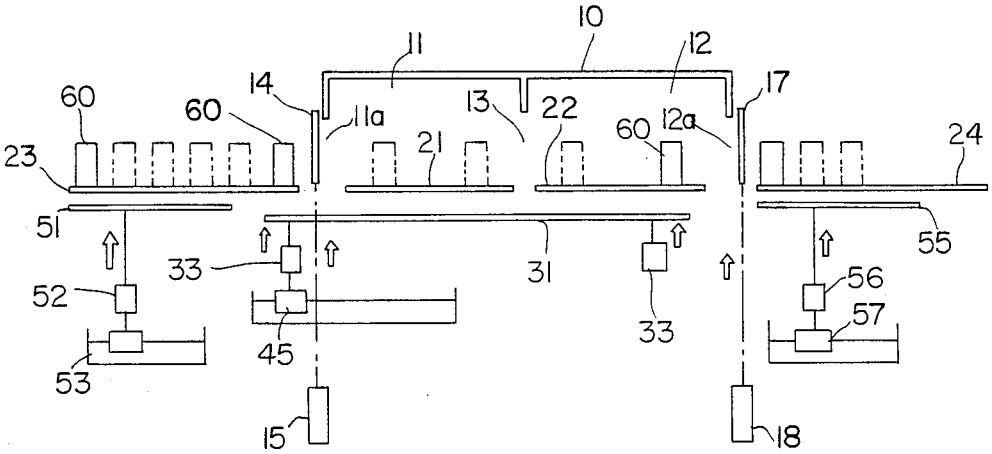
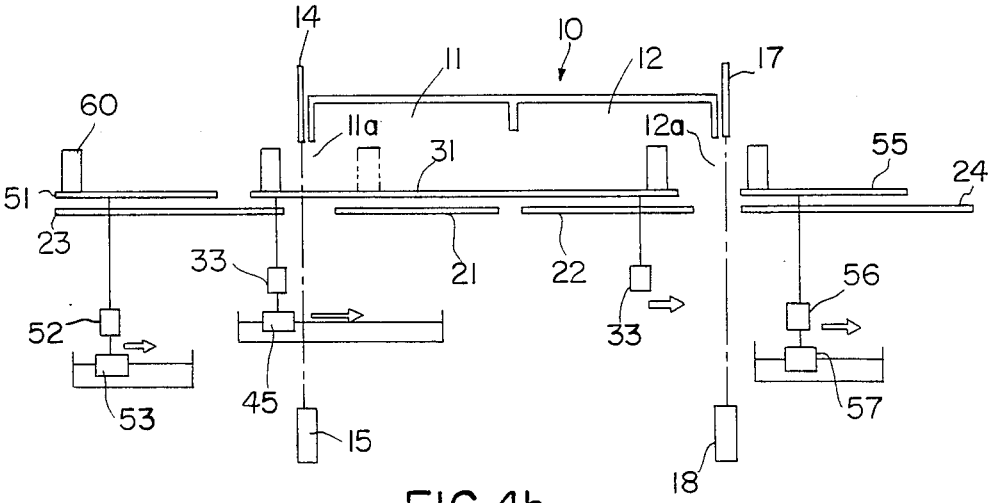
FIG.4b

FIG.4c
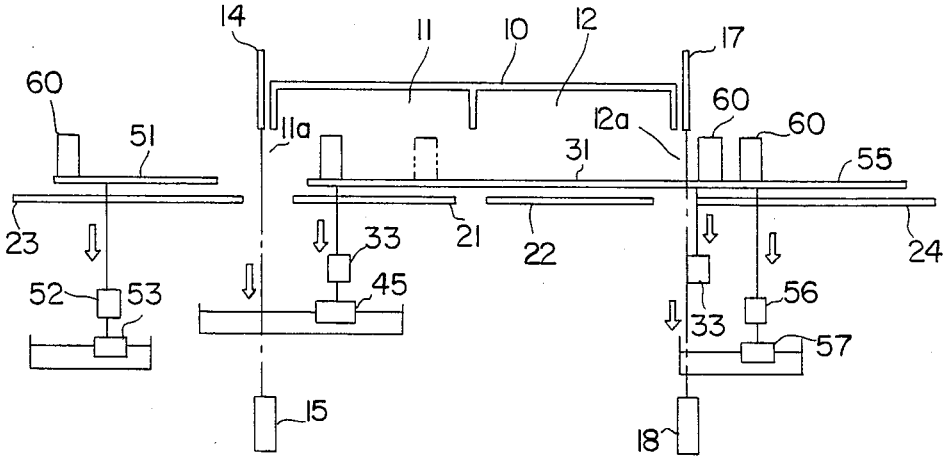
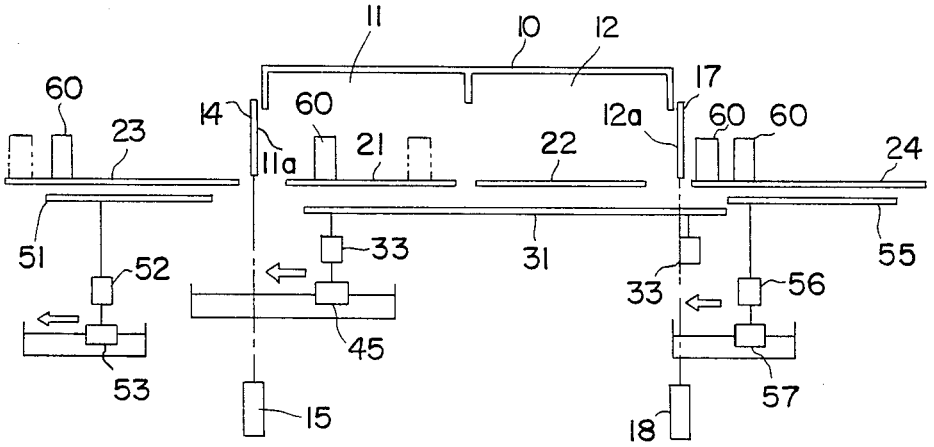
FIG.4d

HEATING APPARATUS

BACKGROUND OF THE INVENTION

1. Field of the Invention

This invention relates to a heating apparatus for heating articles such as an LSI package disposed on a carrier in an atmosphere of nitrogen.

2. Description of the Prior Art

FIG. 5 shows a conventional batch-type heating apparatus for heating articles such as an LSI package disposed on a carrier in an atmosphere of nitrogen. The heating apparatus has a heating chamber 72, the inside of which is heated by a heat source. The articles 60 are placed in the heating chamber 72, to be heated. When the articles 60 are taken in and out of the heating chamber 72, a door 73 of the chamber 72 is opened.

In replacing the heated articles 60 inside of heating chamber 72 with new articles 60 to be heated, it is necessary to take out the previous articles 60 from the heating chamber 72 before putting new ones in, so that workability is reduced. Moreover, although a plurality of articles 60 are heated in the heating chamber 72 at one time, it is difficult to keep the temperature distribution inside of the heating chamber 72 uniform, so that the articles 60 are heated to different degrees depending on the positions in the heating chamber 72 in which the individual articles 60 are placed. There is a possibility that some articles 60 are insufficiently heated while the other articles 60 are heated to the desired degree. Alternatively, if the articles 60 that have been placed in the positions of the chamber 72, heated are then heated to the desired degree, other articles 60 that have been placed in different positions of the chamber 72 must be overheated.

In addition to the heating apparatus mentioned above, a conventional continuous-type heating apparatus is also known, which is provided with a conveyor belt transmission system 81, as shown in FIG. 6, in which articles 60 to be heated are conveyed to a heating chamber 82 by the conveyor belt 81, and then passed through the inside of the heating chamber 82 while being heated. A belt 81*a* is wound around a pair of pulleys 81*b*, and when the conveyor belt transmission system 81 is operated, the belt 81*a* rotates around the pulleys 81*b*. The belt transmission system 81 vibrates during its rotation and the articles 60 on the belt 81*a* also vibrate while being conveyed, so that the heating apparatus is not suitable for heating articles 60, such as semiconductor devices or the like, because they must remain steady while being heated. Moreover, since the belt 81*a* rotates due to the frictional transmission between the belt 81*a* and the pulleys 81*b*, a residue of metal powder results from the friction between the belt 81*a* and the pulleys 81*b*. In the heating apparatus, a metal net with excellent heat stability is used as the belt 81*a* to resist the heating in the heating chamber 82 and the entrance and exit of the heating chamber 82 are normally opened, so that the metal powder resulting from the friction between the belt 81*a* and the pulleys 81*b* is scattered around the heating chamber 82.

Furthermore, in order to use the belt 81*a* made of a metal net or the like in the conveyor belt transmission system 81, a large driving unit becomes necessary.

SUMMARY OF THE INVENTION

The heating apparatus of the invention, which overcomes the above-mentioned and numerous other disadvantages and deficiencies of the prior art, comprises a heating chamber, the inside of which is heated to a fixed temperature, and which is provided with an entrance and an exit through which articles to be heated are taken in and out of said heating chamber, a support on which said articles are supported inside and outside of said heating chamber, a conveyor which moves vertically and horizontally so that the top surface of the conveyor is above and below the top surface of said support and the said conveyor reciprocates in the direction in which the articles are conveyed, and a pair of doors for opening and closing said entrance and exit of said heating chamber, whereby said articles are successively moved over a fixed distance by said conveyor toward said heating chamber.

In a preferred embodiment, the internal air of said heating chamber is higher than atmospheric pressure.

In a preferred embodiment, the articles are supported on said support outside of said heating chamber in the vicinity of said entrance and exit of said heating chamber.

In a more preferred embodiment, the conveyor transfers said articles from the portion of said support outside of said heating chamber through said entrance onto the portion of said support inside of said heating chamber while said conveyor transfers said articles from the portion of said support inside of said heating chamber through said exit onto the portion of said support outside of said heating chamber.

Thus, the invention described herein makes possible the objectives of (1) providing a heating apparatus with a simple structure in which articles such as semiconductor devices are conveyed to the heating chamber without vibration and then properly heated in the heating chamber; (2) providing a heating apparatus in which the heating chamber remains clean even after heating; (3) providing a heating apparatus in which all the articles successively introduced into the heating chamber are uniformly heated; and (4) providing a heating apparatus in which the inside of the heating chamber is maintained at a fixed temperature.

BRIEF DESCRIPTION OF THE DRAWINGS

This invention may be better understood and its numerous objects and advantages will become apparent to those skilled in the art by reference to the accompanying drawings as follows:

FIGS. 4*a*–4*d* are schematic diagrams illustrating the operation of a heating apparatus of the invention.

DESCRIPTION OF THE PREFERRED EMBODIMENTS

Figure 1:
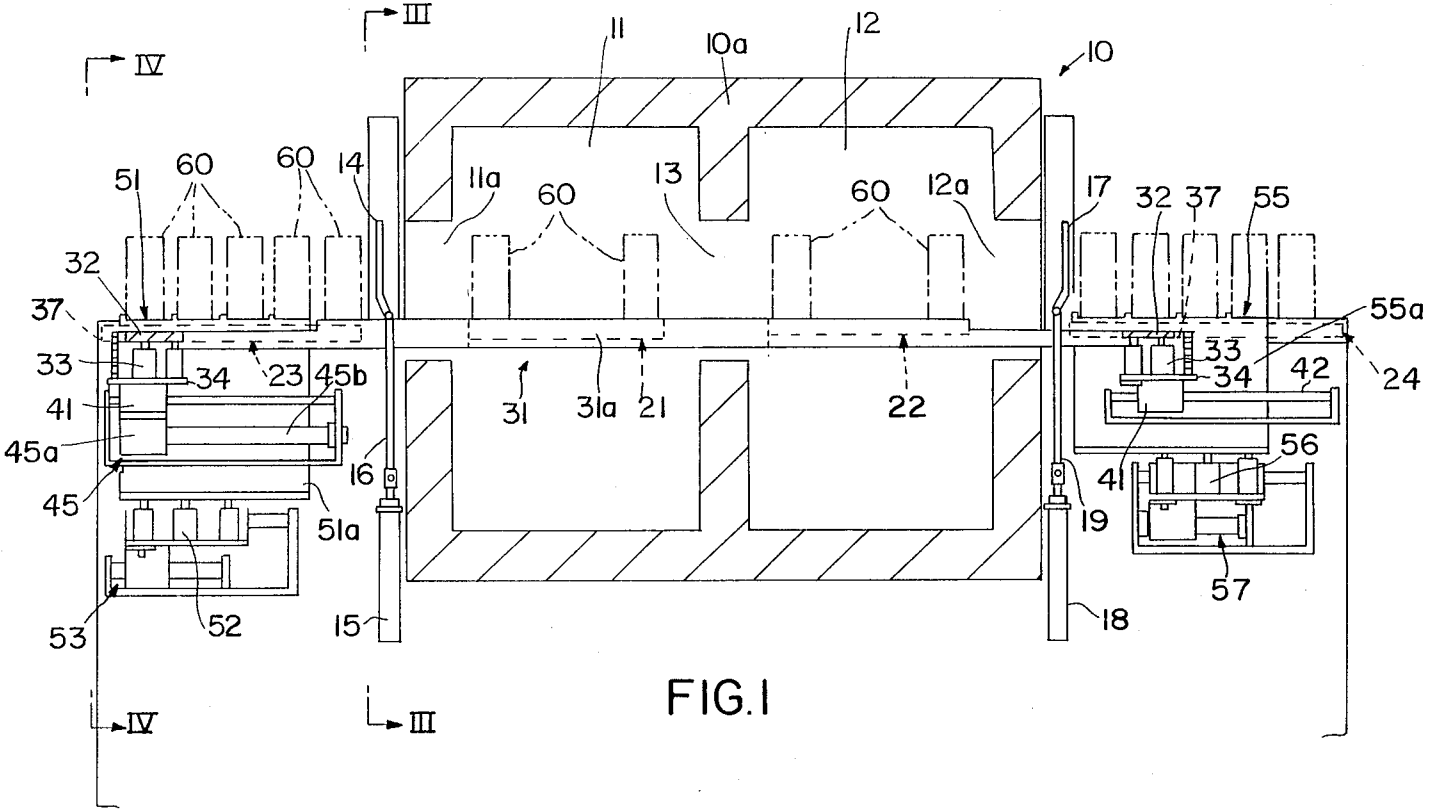
FIG. 1 is a side view diagrammatically showing a heating apparatus of the invention.

FIG. 1 shows a heating apparatus of this invention, which comprises a heating chamber 10, supports 21, 22, 23, and 24 for supporting articles to be heated, and conveyors 51, 31, and 55 for conveying the articles in a given direction. The heating chamber 10 is divided into two sections, i.e., a first section 11 and a second section 12, each of which is overlaid by thermal insulation 10*a*. Below the first and second sections 11 and 12, a heat source such as a heater is provided, so that the nitrogen atmosphere inside of the heating chamber 10 is heated by the heat source and circulated by a fan. In order to prevent external air from flowing into the heating chamber 10, the internal pressure of the heating chamber 10 is kept higher than the external pressure of the heating chamber 10.

The first and second sections 11 and 12 of the heating chamber 10 are connected with each other by a connecting hole 13. The first section 11 is provided with an entrance 11*a* to the heating chamber 10 while the second section 12 is provided with an exit 12*a* from the heating chamber 10. The entrance 11*a*, connecting hole 13 and exit 12*a* are arranged in a line, so that an article 60 to be heated, such as a rack in which an LSI package is disposed, is first introduced into the heating chamber 10 from the entrance 11*a*, and then passed through the connecting hole 13 to go out of the heating chamber 10 from the exit 12*a*. The entrance 11*a* is provided with a liftable door 14, and below the liftable door 14 is an air cylinder 15 for raising and lowering the liftable door 14. A piston rod of the air cylinder 15 is attached to the lower end of a connecting rod 16. As shown in FIG. 3*a*, the upper end of the connecting rod 16 is forked into two branches to be respectively attached to the sides of the liftable door 14. In order to open and close the entrance 11*a*, air cylinder 15 is actuated to raise and lower the liftable door 14.

The exit 12*a* is also provided with a liftable door 17. As shown in FIG. 1, an air cylinder 18 is actuated to raise and lower the liftable door 17, so as to open and close the exit 12*a*.

Figure 2:
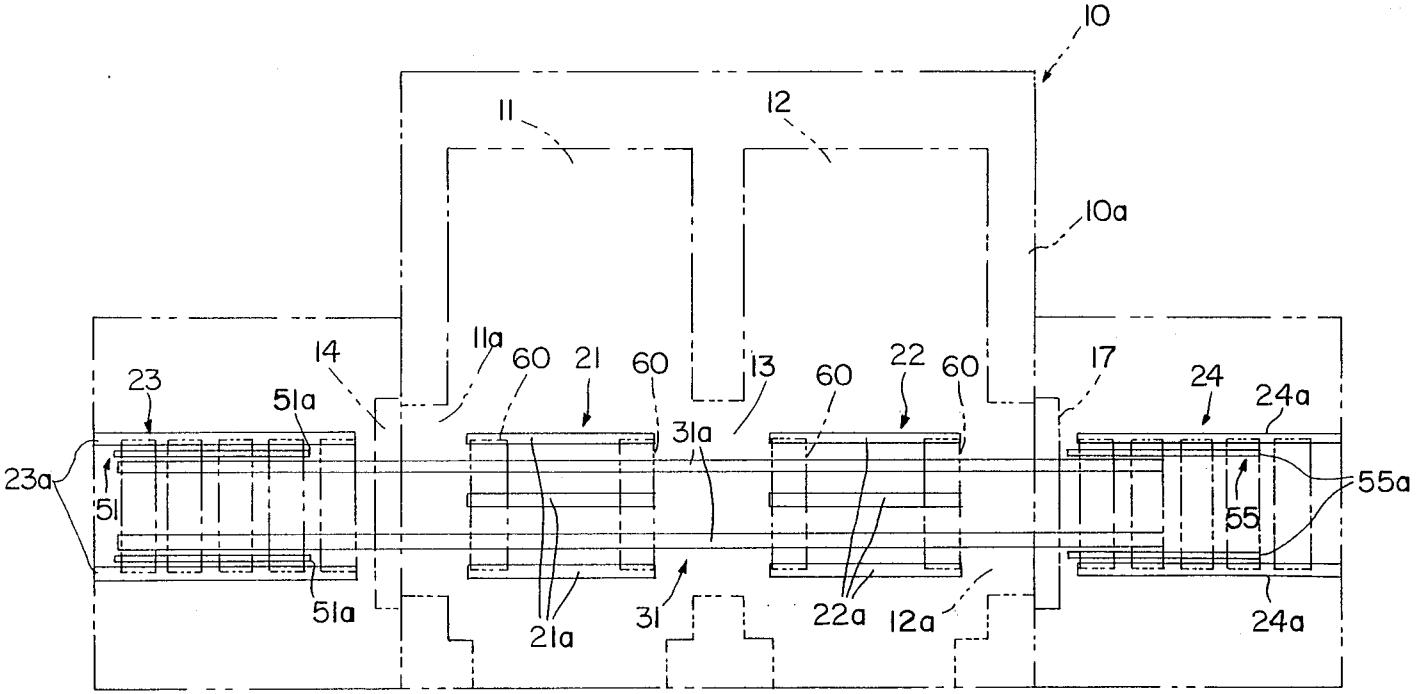
FIG. 2 is a plan view showing the principal portion of the heating apparatus of FIG. 1.

In the first section 11 of the heating chamber 10, as shown in FIG. 2, the support 21 is provided to support the articles to be heated. The support 21 is composed of three pipes 21*a* in the shape of a rectangular parallelepiped, each of which extends from the entrance 11*a* to the connecting hole 13 of the heating chamber 10. The top faces of the three rectangular pipes 21*a* are flush with each other. In the second section 12 of the heating chamber 10, the support 22 is provided to support the articles. The support 22 is also composed of three pipes 22*a* in the shape of a rectangular parallelepiped, each of which extends from the connecting hole 13 to the exit 12*a* of the heating chamber 10. Each pipe 22*a* constituting the support 22 is in alignment with the corresponding pipe 21*a* of the support 21. The top faces of the rectangular pipes 22*a* are flush with the top faces of the rectangular pipes 21*a*.

Outside the heating chamber 10 and adjacent to its entrance 11*a*, there is the support 23 for supporting the articles to be heated. The support 23 is composed of two pipes 23*a* in the shape of a rectangular parallelepiped, which are respectively in alignment with the two outer rectangular pipes 21*a* in the direction of width of the support 21. Outside the heating chamber 10 and adjacent to its exit 12*a*, there is the support 24 for supporting the articles. The support 24 is composed of the two pipes 24*a* in the shape of a rectangular parallelepiped, which are respectively in alignment with the two outer rectangular pipes 22*a* in the direction of width of the support 22. The top faces of the rectangular pipes 23*a* are also flush with the top faces of the rectangular pipes 21*a* and 22*a*. As described below, each article 60 to be heated is successively disposed on the supports 23, 21, 22 and 24 in that order while being conveyed.

The conveyor 31 for conveying the article 60 is provided in the heating chamber 10. The conveyor 31 is composed of a pair of rectangular pipes 31*a*, each of which is placed between the pipes 21*a* in the first section 11 and between the pipes 22*a* in the second section 12, so as to be parallel with the pipes 21*a* and 22*a*. The pipes 31*a* horizontally pass through the heating chamber 10, and their ends are protruding outwards from the entrance 11*a* and exit 12*a* of the heating chamber 10.

The rectangular pipes 31*a* constituting the conveyor 31 in the heating chamber 10 can move both vertically and horizontally in synchronism with each other. When the pipes 31*a* are at their lowest level, their top faces are below the top faces of the rectangular pipes 21*a* and 22*a* of the supports 21 and 22. The level of the top faces of the pipes 31*a* are lowered at both ends, and the articles 60 are disposed on the middle portions between the lowered end portions of the pipes 31*a*.

Figure 3B:
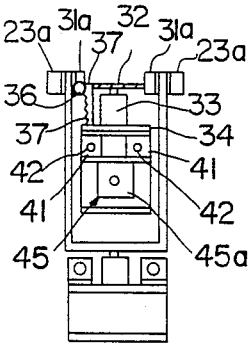
FIG. 3*b* is a cross sectional view the heating apparatus taken along the line IV—IV of FIG. 1.
Figure 3A:
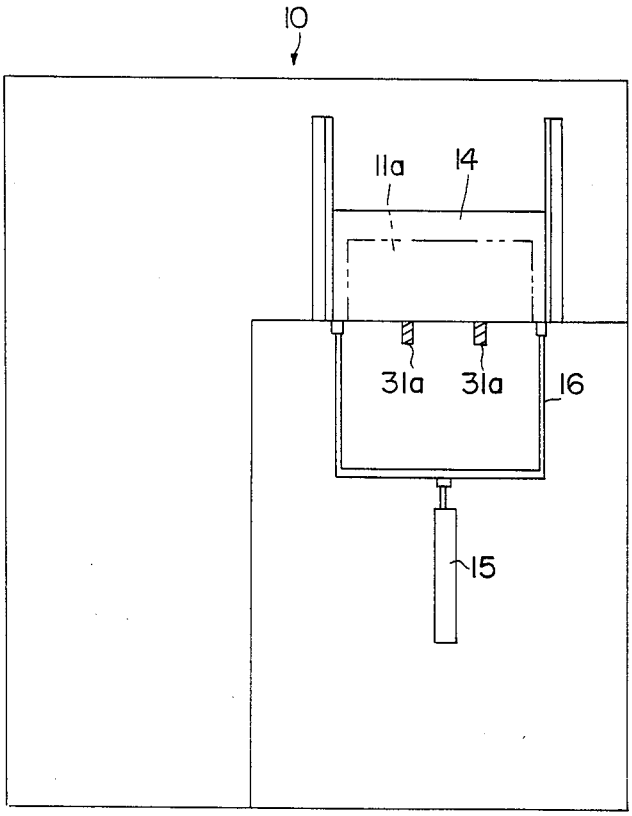
FIG. 3*a* is a cross sectional view of the heating apparatus taken along the line III—III of FIG. 1.
Figure 5:
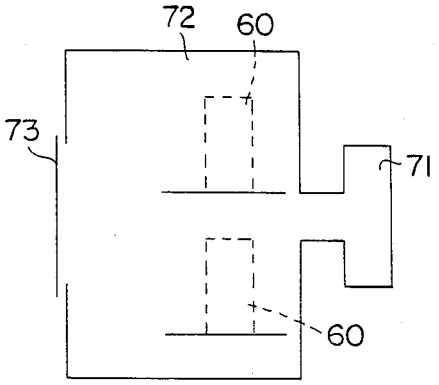
FIGS. 5 and 6 are schematic diagrams respectively showing a conventional heating apparatus.
Figure 6:
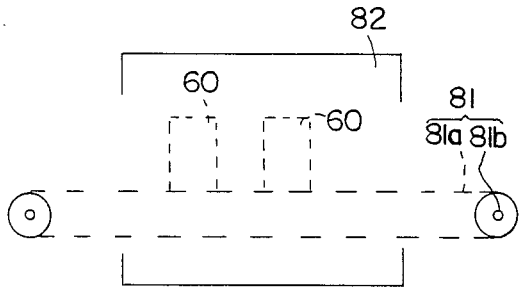

As shown in FIG. 3*b*, the end portions of the rectangular pipes 31*a* protruding from the entrance 11*a* are connected with each other by means of a connecting plate 32. The connecting plate 32, which is placed in a horizontal position, is in turn connected to the piston rod of an air cylinder 33, so that the end portions of the pipes 31*a* are simultaneously raised and lowered in accordance with the raising and lowering of the connecting plate 32 by the air cylinder 33. The end portions of the rectangular pipes 31*a* protruding from the exit 12*a* are also connected with each other by another connecting plate 32, as shown in FIG. 1. The connecting plate 32, which is placed in the horizontal position, is also connected to another air cylinder 33, so that the end portions of the pipes 31*a* are simultaneously raised and lowered in accordance with the raising and lowering of the connecting plate 32 by the air cylinder 33.

Although the air cylinders 33 are operated in synchronism with each other to raise or lower the end portions of the pipes 31*a*, the end portions of one pipe 31*a* protruding from the entrance 11*a* and the exit 12*a* are respectively provided with pinion gears 36, in order to ensure the simultaneous raising and lowering of the pair of pipes 31*a*. The air cylinders 33 are respectively attached to stands 34, on which racks 37 are vertically disposed so as to mesh with the corresponding pinion gears 36. When the pipes 31*a* are raised and lowered by the air cylinders 33, the pinion gears 36 also go up and down while rotating. The rotating pinion gears 36 are kept in contact with the rugged surface of the rack 37, so that the end portions of the pipes 31*a* are simultaneously raised and lowered with high accuracy.

The air cylinders 33 for raising and lowering the end portions of the pipes 31*a* can be moved in the longitudinal direction of the pipes 31*a*, in which direction the article 60 is conveyed.

The air cylinders 33 are respectively fixed to the stands 34, each of which is held by a pair of slidable blocks 41 as shown in FIG. 1. On each side of the heating apparatus, the slidable blocks 41 are respectively pierced by a pair of guiding rods 42 which are parallel with the pipes 31*a*, so that they can be slidably moved along the guiding rods 42.

Below the pipes 23*a* of the support 23, a rodless air cylinder 45 is provided below the slidable blocks 41 so as to reciprocate the slidable blocks 41 in the direction in which the articles are conveyed. In the rodless air cylinder 45, the body 45*a* is moved along the cylinder tube 45b which is parallel with the direction of conveyance of the articles. The body 45a of the rodless air cylinder 45 is attached to both of the slidable blocks 41, so that when the body 45a of the rodless air cylinder 45 is reciprocated along the cylinder tube 45b the slidable blocks 41 are also reciprocated in the direction of conveyance of the articles, thereby reciprocating the air cylinder 33 and the pipes 31a in the direction of conveyance of the articles. With the reciprocating movement of the body 45a of the air cylinder 45, the edge of the middle section of the conveyance 31 on which the articles 60 are disposed are let out of the heating chamber 10.

The conveyor 51 is between the pair of pipes 23a constituting the support 23. The conveyor 51 comprises a pair of flat plates 51a, each of which is placed in a vertical position between and along the pipe 23a of the support 23 and the pipe 31a of the conveyor 31. The conveyor 51, like the conveyor 31 mentioned above, can be moved both vertically and horizontally.

The top faces of the flat plates 51a of the conveyor 51 are below the top faces of the pipes 23a of the rectangular pipes 23a of the support 23 at their lowest level.

The flat plates 51a constituting the conveyor 51 extends downward in such a manner as to sandwich the air cylinders 31 and 33 therebetween, and when the flat plates 51a are not lifted, their lower edges are positioned below the air cylinder 45. The flat plates 51a are raised and lowered by an air cylinder 52 which is provided below the air cylinder 45. Below the air cylinder 52, a rodless air cylinder 53 is provided to reciprocate the flat plates 51a in the direction of conveyance of the articles. The stroke of the air cylinder 53 is considerably smaller compared with the stroke of the air cylinder 45. The structure of the air cylinders 33 and 45 will not be described here in detail, since they are substantially identical with the structure of the air cylinders 33 and 45.

Between the pipes 24a constituting the support 24 is interposed the conveyor 55. The conveyor 55, like the conveyor 51, comprises a pair of flat plates 55a. The flat plates 55a are raised and lowered by an air cylinder 56, and are reciprocated by an air cylinder 57 in the direction of conveyance of the article. The structure of the air cylinders 56 and 57 are identical with that of the air cylinders 52 and 53.

With reference to the FIG. 4, the operation of the heating apparatus of the invention will be described.

The article 60 to be heated is first disposed on the front-edge portion of the support 23 over the pair of pipes 23a (See FIG. 2). Then, the air cylinder 52 is actuated to raise the conveyor 51 until the top faces of the flat plates 51a lift up the article 60 from the front-edge portion of the support 23 (See FIG. 4b). When the article 60 is lifted up from the support 23 by the conveyor 51, the air cylinder 52 is stopped so that the conveyor 51 holds the article 60 above the support 23.

The air cylinder 53 is then operated to horizontally move the air cylinder 52 over a given distance toward the heating chamber 10, so that the position of the article 60 is horizontally shifted by a given distance toward the heating chamber 10, as shown in FIG. 4c. When the operation of the air cylinder 53 is stopped, the air cylinder 52 is actuated to lower the conveyor 51 until the top faces of the flat plates 51a are below the top faces of the pipes 23a and the article 60 is transferred onto the support 23, as shown in FIG. 4c.

In this way, the position of the article 60 on the support 23 is successively shifted by a given distance toward the heating chamber 10, so that the article 60 is conveyed to the heating chamber 10. Other articles 60 are continuously supplied onto the front-edge portion of the support 23, so that all the articles 60 disposed on the support 23 are simultaneously moved by the conveyor 51 over a given distance toward the heating chamber 10.

As shown in FIG. 4a, when the article 60 reaches the back-edge portion of the support 23 to face the entrance 11a of the heating chamber 10, the air cylinders 33 are actuated to raise the conveyor 31 in synchronism with the rising of the conveyor 51. The conveyor 31 is kept in a horizontal position while being raised. With the rising of the conveyor 31, the air cylinders 15 and 18 are actuated to raise the doors 14 and 17 so that the entrance 11a and exit 12a, which are respectively closed by the doors 14 and 17, are opened. As described above, the pressure of the air inside the heating chamber 10 is kept higher than the pressure of the air outside the heating chamber 10, and there is no possibility that external air will flow into the heating chamber 10 even when the entrance 11a and exit 12a are opened by the raising of the doors 14 and 17. As shown in FIG. 4b, when the air cylinders 33 raise the conveyor 31, the top faces of the flat plates 31a of the conveyor 31 lift up the article 60 from the support 23.

After the article 60 is lifted and held in the elevated position by the conveyor 31, the air cylinder 45 is actuated to horizontally move the air cylinder 33 over a given distance toward the heating chamber 10. Consequently, the conveyor 31 is also horizontally moved over a given distance, so that the article 60 placed on the edge of the middle portion of the conveyor 31 is transferred into the first section 11 through the entrance 11a of the heating chamber 10. Thereafter, the air cylinders 33 are simultaneously operated to lower the conveyor 31 until the article 60 is transferred onto the support 21 from the conveyor 31 and the top faces of the flat plates 31a are below the top faces of the rectangular pipes 21a.

When the conveyor 31 is lowered, the air cylinders 15 and 18 which are respectively attached to the doors 14 and 17 are actuated to lower the doors 14 and 17, thereby closing the entrance 11a and exit 12a.

In the first section 11 of the heating chamber 10, the article 60 on the support 21 is heated in two positions respectively over a given period of time, and then transferred into the second section 12 of the heating chamber 10 via the connecting hole 13 through the same operation of the conveyor 31 and doors 14 and 17, as described above. While the article 60 is transferred into the section 12, another article 60 is newly introduced into the section 11, so as to be heated. The article 60, after being transferred into the second section 12, is further heated in two positions respectively over the given period of time. By operating the conveyor 31 and doors 14 and 17 once more, the articles 60 which was heated over a required period of time is moved out of the heating chamber 10 through the exit 12a and transferred onto the support 55.

In this way, the articles 60, which were heated in the two positions respectively over the given period of time in the first section 11, were successively moved into the second section 12, to be heated in the two positions respectively over the given period of time and then moved out of the heating chamber 10.

The articles 60, after being heated, are disposed on the support 24 and conveyed away from the heating chamber 10 by the conveyor 55. The operation of the conveyor 55 will not be described here in detail, since it is identical with the operation of the conveyor 51.

In the aforementioned example, the two supports are separately used inside and outside the heating chamber 10 to support the articles 60, but it is possible to use a single support to support the articles 60 inside and outside the heating chamber 10. It is also possible to integrate the three conveyors 51, 31 and 55 into a single conveyor, so that the single conveyor can be driven by a single power source. A heating apparatus with the single conveyor can be easily controlled due to its simple structure.

It is also possible to replace the conveyor 31 with two separate conveyors which are driven by one power source, so that the articles are let in and out of the heating chamber 10 by one conveyor while they are conveyed inside the heating chamber 10 by the other conveyor. With the two separate conveyors, the frequency of the opening and closing of the doors can be reduced and the lowering of temperature inside the heating chamber can be prevented. Moreover, it is possible to keep the temperature distribution uniform inside the heating chamber.

In the aforementioned example, the number of sections into which the heating chamber 10 is divided is two, but it is possible to divide the heating chamber 10 into more than two sections.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A heating apparatus comprising a heating chamber the inside of which is heated to a fixed temperature and which is provided with an entrance and an exit through which articles to be heated are taken in and out of said heating chamber, a support, and a conveyor, said support for supporting said articles until they are conveyed by the conveyor, the conveyor for moving vertically so that its top surface is above and below the top surface of the support and for moving horizontally for conveying said articles on said support from inside to outside said heating chamber, and further including a pair of doors for opening and closing said entrance and exit of said heating chamber, whereby said articles are successively moved over a fixed distance by said conveyor toward said heating chamber.

2. A heating apparatus according to claim 1, wherein said heating chamber has a higher internal pressure than atmospheric pressure so as to prevent outside air from entering said heating chamber.

3. A heating apparatus according to claim 1, wherein said articles are supported on said support outside of said heating chamber in the vicinity of said entrance and exit of said heating chamber.

4. A heating apparatus according to claim 3, wherein said conveyor transfers said articles from the portion of said support outside of said heating chamber through said entrance onto the portion of said support inside of said heating chamber while said conveyor transfers said articles from the portion of said support inside of said heating chamber through said exit onto the portion of said support outside of said heating chamber.

* * * * *